US010624200B2

(12) United States Patent
Qiao et al.

(10) Patent No.: US 10,624,200 B2
(45) Date of Patent: Apr. 14, 2020

(54) UNDULATOR

(71) Applicant: SHANGHAI INSTITUTE OF MICROSYSTEM AND INFORMATION TECHNOLOGY, CHINESE ACADEMY OF SCIENCES, Shanghai (CN)

(72) Inventors: Shan Qiao, Shanghai (CN); Rui Chang, Shanghai (CN); Fuhao Ji, Shanghai (CN); Mao Ye, Shanghai (CN)

(73) Assignee: SHANGHAI INSTITUTE OF MICROSYSTEM AND INFORMATION TECHNOLOGY, CHINESE ACADEMY OF SCIENCES, Shanghai (CN)

( * ) Notice: Subject to any disclaimer, the term of this patent is extended or adjusted under 35 U.S.C. 154(b) by 365 days.

(21) Appl. No.: 15/527,447

(22) PCT Filed: Nov. 13, 2015

(86) PCT No.: PCT/CN2015/094570
§ 371 (c)(1),
(2) Date: Dec. 5, 2017

(87) PCT Pub. No.: WO2016/078547
PCT Pub. Date: May 26, 2016

(65) Prior Publication Data

US 2018/0098412 A1 Apr. 5, 2018

(30) Foreign Application Priority Data

Nov. 17, 2014 (CN) ..... 2014 1 0652902

(51) Int. Cl.
*H01F 7/02* (2006.01)
*H05H 7/04* (2006.01)
(Continued)

(52) U.S. Cl.
CPC ..... *H05H 7/04* (2013.01); *G21K 1/003* (2013.01); *H01F 7/02* (2013.01); *H01F 7/0278* (2013.01);
(Continued)

(58) Field of Classification Search
CPC ..... H05H 7/04; H05H 13/04; H01F 7/0278; G21K 1/003
(Continued)

(56) References Cited

U.S. PATENT DOCUMENTS 4,731,598 A * 3/1988 Clarke ..... H01F 7/0278 315/5.35
4,800,353 A * 1/1989 Csonka ..... H01F 7/0278 335/210
(Continued)

FOREIGN PATENT DOCUMENTS

CN 104409129 3/2015

OTHER PUBLICATIONS

Zhu, Ya et al., "Mechanical Design and Analysis on the Magnetic Structure of an Novel Permanent Magnet Undulator in SSRF", Nuclear Techniques, vol. 38, No. 3,Mar. 31, 2015 (Mar. 31, 2015), pp. 030103-1,030103-2,030102-3,030103-4 and 030102-5.
(Continued)

*Primary Examiner* — Shawki S Ismail
*Assistant Examiner* — Lisa N Homza
(74) *Attorney, Agent, or Firm* — Global IP Services; Tianhua Gu

(57) ABSTRACT

An undulator comprises at least M permanent magnet periods arranged sequentially in a transmission direction of electron beams, each of the permanent magnet periods comprises four rows of permanent magnet structures, in which each row comprises N rows of permanent magnet groups, and each row of the permanent magnet groups
(Continued)

comprises K permanent magnet units, wherein M, N and K are natural numbers greater than or equal to 1; the four rows of the permanent magnet structures are pairwise matched, then relatively disposed on both sides of the transmission direction of electron beams, and are capable of forming at least one composite magnetic fields by relative displacement, such that elliptically polarized light, circularly polarized light, or linearly polarized light with an arbitrary polarization angle of 0°~360° is generated when electron beams pass through the composite magnetic fields, and such that velocity directions of electrons are deviated from an axis direction of the undulator.

10 Claims, 11 Drawing Sheets

(51) Int. Cl.
*G21K 1/00* (2006.01)
*H05H 13/04* (2006.01)

(52) U.S. Cl.
CPC ..... *H05H 13/04* (2013.01); *H05H 2007/041* (2013.01)

(58) Field of Classification Search
USPC ..... 335/306
See application file for complete search history.

(56) References Cited

U.S. PATENT DOCUMENTS 4,893,103 A * 1/1990 Leupold ..... H01F 6/00 315/5.35
4,949,344 A * 8/1990 van Steenbergen .. H01S 3/0903 372/2
4,977,384 A * 12/1990 Tatchyn ..... H01F 7/0278 315/5.35
5,014,028 A * 5/1991 Leupold ..... H01F 7/0278 315/3.5
5,019,863 A * 5/1991 Quimby ..... H01F 7/0278 315/5.35
RE33,736 E * 11/1991 Clarke ..... H01F 7/0278 315/5.35
5,565,747 A * 10/1996 Sasaki ..... H01F 7/0284 315/503
5,596,304 A * 1/1997 Tatchyn ..... H01F 7/0278 335/210
5,666,098 A * 9/1997 Leupold ..... H01F 7/0278 315/5.34
6,057,656 A * 5/2000 Ohashi ..... H01F 7/0278 315/503
6,858,998 B1 * 2/2005 Shenoy ..... H05H 13/04 315/501
6,954,128 B2 * 10/2005 Humphries ..... B03C 1/288 335/285
7,129,807 B2 * 10/2006 Rossmanith ..... H05H 7/04 335/216
7,196,601 B1 * 3/2007 Gottschalk ..... H05H 7/04 315/5.35
7,872,555 B2 * 1/2011 Kitamura ..... H05H 7/04 315/501
8,009,001 B1 * 8/2011 Cleveland ..... H02P 6/14 310/156.31
10,062,486 B1 * 8/2018 Gluskin ..... H01F 6/06
10,312,006 B2 * 6/2019 Yamamoto ..... H01F 7/0278
2006/0038648 A1 * 2/2006 Humphries ..... B03C 1/0332 335/306
2007/0182517 A1 * 8/2007 Humphries ..... H01F 7/0252 335/306
2011/0172104 A1 * 7/2011 Moser ..... H05H 7/04 505/150
2015/0255201 A1 * 9/2015 Jeong ..... H05H 7/04 335/306
2017/0339777 A1 * 11/2017 Kinjo ..... H05H 13/04
2019/0075646 A1 * 3/2019 Kuo ..... H05H 7/04

OTHER PUBLICATIONS

Sasaki, S. et al., "Design Study of Knot-Apple Undulator for Pes-Beamline at SSRF", Proceedings of PAC2013, Pasadena, Causa, Jun. 30, 2014 (Jun. 30, 2014), pp. 1043-1045.
Marks, S. et al., "The Advanced Light Source Elliptically Polarizing Undulator", IEEE, vol. 3,Dec. 31, 1998 (Dec. 31, 1998), pp. 3221-3223.
Lu, Jie et al., "Field Integral Shimming of Elliptically Polarized Undulator at Shanghai Synchrotron Radiation Facility", High Power Laser and Particle Beams, vol. 21, No. 10,Oct. 31, 2009 (Oct. 31, 2009), pp. 1597-1600.
He, Junyong et al., "Analysis and Calculation of Backing Beam for EPUI00 at SSRF", Nuclear Techniques, vol. 32, No. 8,Aug. 31, 2009 (Aug. 31, 2009), pp. 572-575.

* cited by examiner

UNDULATOR

CROSS REFERENCE TO RELATED PATENT APPLICATION

The present application is the US national stage of PCT/CN2015/094570 filed on Nov. 13, 2015, which claims the priority of the Chinese patent application No. CN2014106529023 filed on Nov. 17, 2014, which applications are incorporated herein by reference.

TECHNICAL FIELD

The present invention relates to technical field of synchrotron radiation, and more particularly, to an undulator.

BACKGROUND

Synchrotron radiation is short for synchrotron accelerator radiation, which is high-intensity and highly-collimated light beams emitted when high-energy electrons deflect in a magnetic field. In order to generate synchrotron radiation having a higher intensity, a large number of present synchrotron radiation devices use undulators. The undulator generates a magnetic field which varies periodically. High-energy electron beams periodically moves in the undulator, and the generated light has a higher intensity due to an interference effect. With the development of accelerator technology, the divergence of electron beam current becomes smaller and smaller, and the thermal loads (the sum of the power of all energy photons) on optical elements (such as mirrors, gratings and crystals) becomes larger and larger. On the other hand, with the improvement of processing technology, the surface machining errors of optical elements can fully meet the requirements, and the surface machining errors of optical elements (such as deformation) caused by thermal loads have become a decisive factor which affects the performance of light beam line. Therefore, high thermal loads have become an urgent problem to be solved by modern synchronous radiator devices. As for synchrotron radiation, the heat loads are emitted, due to a relativistic effect, at a very small divergence angle (defined as a divergence angle of 90% photons, and 0.008° for electron energy of 3.5 GeV) along a velocity direction of electron movement. As for undulators which generate circularly polarized light, the velocity direction thereof is never along the axis direction of the undulators due to the helical movement of electrons. The direction of extreme value of the thermal load deviates from the axis of the undulator. Most of the thermal loads can be filtered out by a diaphragm, and will not be irradiated onto optical elements. As for linearly polarized undulators as commonly used, electrons make a serpentine movement in a horizontal plane or in a vertical plane, and the velocity direction thereof will sweep through an axis of the undulator, thereby causing a larger thermal load of the light beam line.

In order to solve the problem of high thermal load, Japanese Dr. Tanaka proposed a Figure-8 undulator structure (T. Tanaka and H. Kitamura, nuclear instruments and methods in physics research, section A 364 (1995), 368-373): linearly polarized light can be generated by using left and right lateral movements of electronics cascade and the coherence of circularly polarized light, the ratio of the magnet period in a horizontal direction to a vertical direction is 1:2, and the movement trajectory of electrons is shown in FIG. 1. Because the movement trajectory of electrons is a left and right lateral movement, the velocity direction of electrons will never be along the axis of undulator, such that the thermal loads deviate from the axis of the undulator. At the same time, the coherent light is strongest along the axis of the undulator, thus the problem of thermal loads generated when synchrotron radiation generates linearly polarized light is solved. However, the Figure-8 undulator merely generates linearly polarized light and does not generate circularly polarized light. Since the second harmonic of the Figure-8 undulator along a long period direction is capable of interfering with the fundamental wave along a short period direction, pure linearly polarized light cannot be generated. The APPLE (Advanced Planar Polarized Light Emitter) undulator proposed by professor Sasaki (Sasaki, nuclear instruments and methods in physics research, section A 347 (1994), 83-86) can generate synchrotron radiation polarized light having arbitrarily polarizations by a relative displacement between the moving magnet groups and the stationary magnet groups, and the arrangement structure of magnet is shown in FIG. 2. However, when linear polarized synchrotron radiation is generated, the magnetic field of APPLE undulator is the same as that of a linearly polarized undulator as commonly used, and therefore the problem of thermal loads cannot be solved. Later, professor Sasaki proposed another APPLE-8 undulator (S. Sasaki et. al., EPAC98, p 2237 (1998)) based on the APPLE undulator and the Figure-8 undulator. The undulator consists of two standard APPLE magnet groups. An APPLE undulator consisting of four rows of inner magnet groups is used to generate synchrotron radiation. An APPLE undulator consisting of outer four rows of magnet groups cooperates with the inner APPLE undulator to create figure-8 movement. The inner undulator and outer undulator have a period ratio of 1:2. As shown in FIG. 3, synchrotron radiation polarized light having arbitrary polarization can be generated through the displacement of diagonal four-column moving magnet. However, since the Figure-8 undulator cannot generate pure linear polarized light, the degree of linear polarization of the APPLE-8 undulator can only reach 82%.

In order to generate arbitrary polarization synchrotron radiation of low thermal loads, the present inventors proposed a running mode of a Knot (knot type) undulator based on an electromagnetic undulator (S. Qiao et. al., Review of Scientific Instruments 80 (2009), 085108), which thoroughly solves the problem of thermal loads of synchrotron radiation. The Knot undulator generates linearly polarized synchrotron radiation having low thermal loads by using left and right lateral movements of electronics cascade. Since the ratio of a magnet period in a horizontal direction to a vertical direction is 3:2, the degree of linear polarization is as high as 99.2%. Moreover, left and right laterally circularly polarized light can be generated through the switching of electromagnet polarity and current. However, due to the hysteresis effect of electromagnets, the size of magnetic fields is related to the history of magnetizing current, which may adversely affect the stable operation of accelerators. In addition, the electromagnet needs to be electrified to maintain its magnetic field, which is unfavorable to energy saving and emission reduction. Considering the above two points, based on the structure of the Knot undulator proposed by the present inventor, professor Sasaki proposed a APPLE-Knot undulator structure as shown in FIG. 4 based on permanent magnet. The APPLE-Knot undulator structure is composed of inner four rows of standard APPLE magnet groups and four rows of APPLE magnet groups having a vacant region outside. Due to the introduction of vacant region, the period ratio of the magnetic field generated by the outer magnet groups and the magnetic field generated by the inner magnet groups is 3:2. In this configuration, the magnetic fields of the middle four rows of magnets provide the magnetic field required by the synchrotron radiation. In the following descriptions, it is named as a main magnetic field or an APPLE magnetic field. The magnetic field of the outer four rows of magnets has a cascading 90° and −90° phase difference with the main magnetic fields, such that a Knot movement mode is generated. In the following descriptions, it is named as an auxiliary magnetic field or a Knot magnetic field. FIG. 5 shows the magnetization directions of each permanent magnet units corresponding to the main magnetic field and the auxiliary magnetic field in each row of the permanent magnet structure in FIG. 4. However, if the structure as shown in FIG. 4 is used, since the distance between the outer four rows of magnets is large, the Knot magnetic field intensity generated by the outer four rows of magnets is too weak, and the velocity direction of electrons deviates from the axis of the undulator by a limited angle, thus the peak direction of the heat loads deviates from the axial of the undulator by a limited angle, and most of the thermal loads cannot be effectively removed.

SUMMARY

In view of the disadvantages of the prior art described above, an object of the present invention is to provide an undulator for solving the technical problem that thermal loads is large when undulators of the prior art generates synchrotron radiation and the auxiliary magnetic field generated by the outer four rows of magnets of the APPLE-Knot undulator is too weak to effectively remove the heat loads.

In order to achieve the above object and other related purposes, the present invention provides an undulator, wherein the undulator comprises: at least M permanent magnet periods arranged sequentially in a transmission direction of electron beams, each of the permanent magnet periods comprises four rows of permanent magnet structures, and each row of the permanent magnet structures comprises N rows of permanent magnet groups, and each row of the permanent magnet groups comprises K permanent magnet units, wherein M, N and K are natural numbers greater than or equal to 1.

The four rows of the permanent magnet structures are pairwise matched, then relatively disposed on both sides of the transmission direction of electron beam, and are capable of forming at least one kind of composite magnetic fields by relative displacement, such that elliptically polarized light, circularly polarized light, or linearly polarized light with an arbitrary polarization angle of 0°~360° is generated when the electron beams pass through the composite magnetic fields, and such that velocity directions of electrons are deviated from an axis direction of the undulator.

Preferably, each row of the permanent magnet structures comprises two rows of permanent magnet groups, wherein one row of permanent magnet groups generates a main magnetic field, and the other row of permanent magnet groups generates an auxiliary magnetic field; wherein the main magnetic field and the auxiliary magnetic field have different magnetic field periods.

Preferably, a ratio of the magnetic field periods of the main magnetic field to the auxiliary magnetic field is 2:3.

Preferably, the permanent magnet units included in the permanent magnet groups corresponding to the auxiliary magnetic field have a magnetization direction perpendicular to a magnetic gap direction of the undulator, and a magnetic field period of the auxiliary magnetic field is adapted to be adjusted by setting a vacant region of the permanent magnet units contained in its corresponding permanent magnet groups.

Preferably, each row of the permanent magnet structures comprises a row of permanent magnet groups which comprises K permanent magnet units having different magnetic deflection angles.

Preferably, the permanent magnet groups are adapted to adjust the ratio of magnetic field intensity between the main magnetic field and the auxiliary magnetic field by decomposing its magnetic field into the main magnetic field and the auxiliary magnetic field having different magnetic field periods and by adjusting the magnetic deflection angle of each permanent magnet unit included in the permanent magnet groups.

Preferably, the main magnetic field and the auxiliary magnetic field are adapted to be adjusted according to an energy of fundamental wave photons, an energy of electron beams and a length of the undulator as needed such that an angle between an electron velocity direction and an axis direction of the undulator is greater than half of an acceptance angle of the fundamental wave photons as needed, thereby obtaining a maximum light intensity under a condition of a smaller thermal load.

Preferably, the energy of the electron beams is 3.5 GeV, the length of the undulator is 4.5 m, the energy of the fundamental wave photons as needed is 7 eV, the acceptance angle is 0.6 mrad, each row of the permanent magnet structures comprises a row of permanent magnet groups, wherein a ratio of the magnetic field intensity between the main magnetic field and the auxiliary magnetic field formed by the permanent magnet groups is 7:3; wherein the permanent magnet groups comprise 24 permanent magnet units; a clockwise direction is regarded to be positive, a upward vertical direction is regarded as a standard of zero angle, and the magnetic deflection angles of the 24 permanent magnet units are respectively 0°, −23°, 67°, 67°, 157°, 157°, −113°, −113°, −23°, 0°, 90°, 90°, 180°, −157°, −67°, −67°, 23°, 23°, 113°, 113°, −157°, 180°, −90°, −90°.

Preferably, the permanent magnet units are made of neodymium iron boron material, and saturation magnetic field intensity of the permanent magnet units are larger than or equal to 1.25 T.

Preferably, the undulator further comprises: a stationary magnet bracket and a moving magnet bracket, and the two rows of permanent magnet structures which are matched pairwise are respectively fixed on the stationary magnet bracket and the moving magnet bracket to respectively form a fixed permanent magnet structure and a moving permanent magnet structure; driven by the moving magnet bracket, the moving permanent magnet structure is adapted to move different displacements relative to the fixed permanent magnet structure to generate different composite magnetic fields, thereby generating polarized light having different polarizations.

As described above, the undulator of the present invention has the following beneficial effects:

Firstly, many kinds of complex magnetic fields can be formed in the undulator of the present invention. Under the function of the composite magnetic fields, linearly polarized synchrotron radiation, elliptic polarized synchrotron radiation or circular polarized synchrotron radiation can be generated by left and right lateral movements of electrons. The velocity direction of electrons will never be along the axis direction of the undulator, and an angle between the velocity direction of electrons and the axis direction of the undulator is greater than half of an divergence angle of the fundamental wave photons as needed, such that most of the thermal loads can be filtered out via a diaphragm, and the heat loads on optical elements of the beam line of synchrotron radiation can be greatly reduced.

Secondly, the present invention can use four rows of permanent magnet groups. Compared with the APPLE-8 undulator, the present invention uses fewer rows of permanent magnets, which significantly saves cost and is easier to be installed.

Thirdly, the undulator of the present invention can not only generate horizontally polarized light and vertically polarized light, but also generate ellipticly polarized light and circularly polarized light. Therefore, the present invention can satisfy many kinds of application needs in synchrotron radiation.

DESCRIPTION OF COMPONENT MARK NUMBERS

Figure 1:
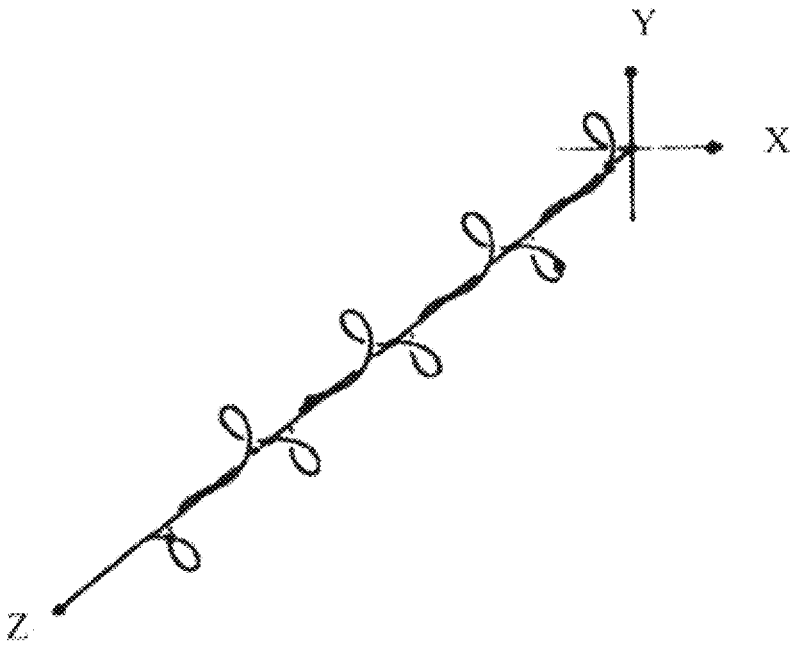
FIG. 1 (PRIOR ART)
FIG. 1 shows a schematic diagram illustrating the movement trajectory of the electron beam when passing through the Figure-8 undulator according to the prior art indicated by the present invention.
Figure 2:
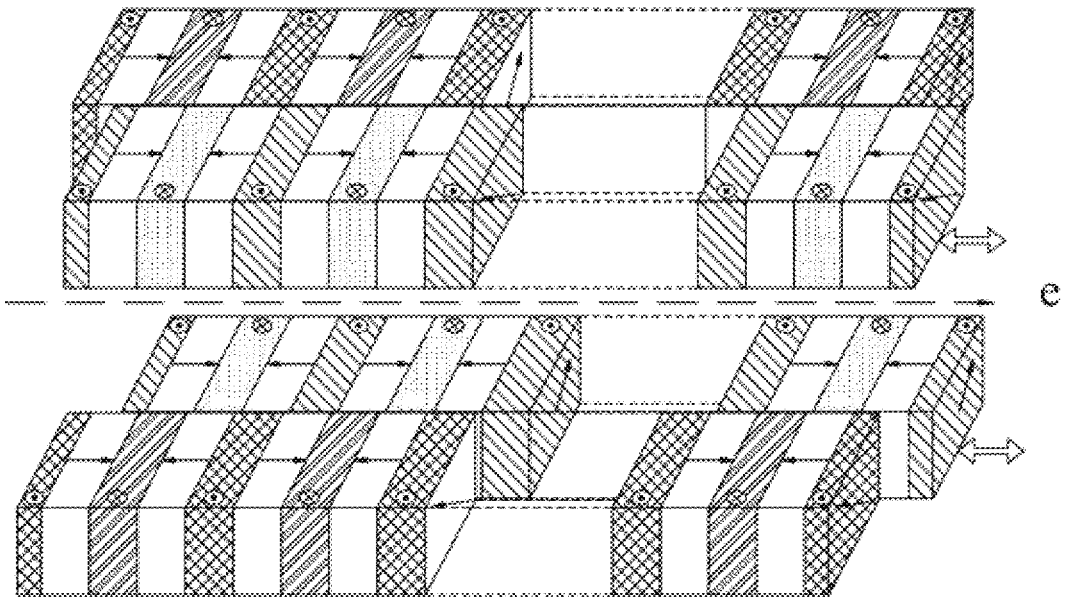
FIG. 2 (PRIOR ART)
FIG. 2 shows a schematic diagram illustrating the arrangement of the magnets in the APPLE undulator according to the prior art indicated by the present invention.
Figure 3:
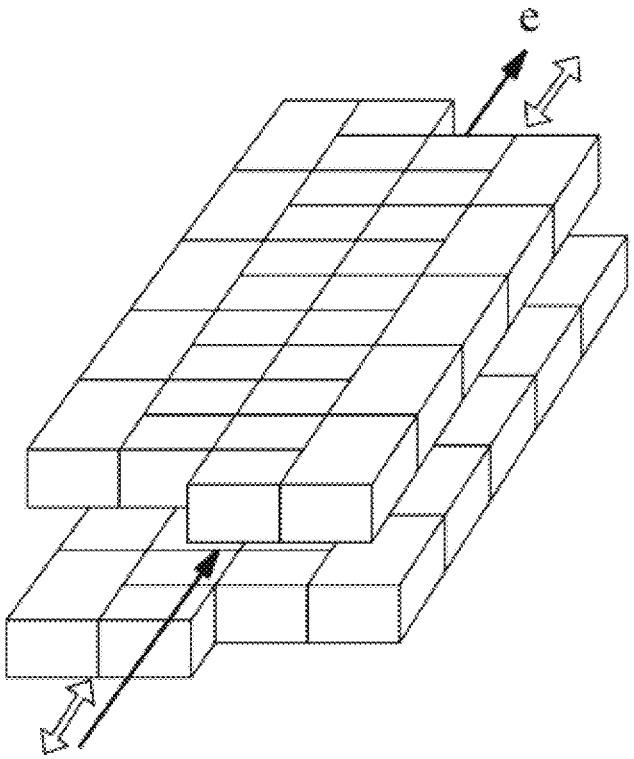
FIG. 3 (PRIOR ART)
FIG. 3 shows a schematic diagram illustrating the arrangement of magnets in the APPLE-8 undulator according to the prior art indicated by the present invention.

100 First permanent magnet structure
200 Second permanent magnet structure
300 Third permanent magnet structure
400 Fourth permanent magnet structure
500 Magnetic gap
600 Vacant region

DETAILED DESCRIPTION OF THE PREFERRED EMBODIMENTS

The implementation modes of the present invention will be described below through specific examples. Those skilled in the art can easily understand other advantages and effects of the present invention according to the content disclosed in the description. The present invention may also be implemented or applied through other different specific implementation modes. Various modifications or variations may be made to all details in the description based on different points of view and applications without departing from the spirit of the present invention.

Figure 6:
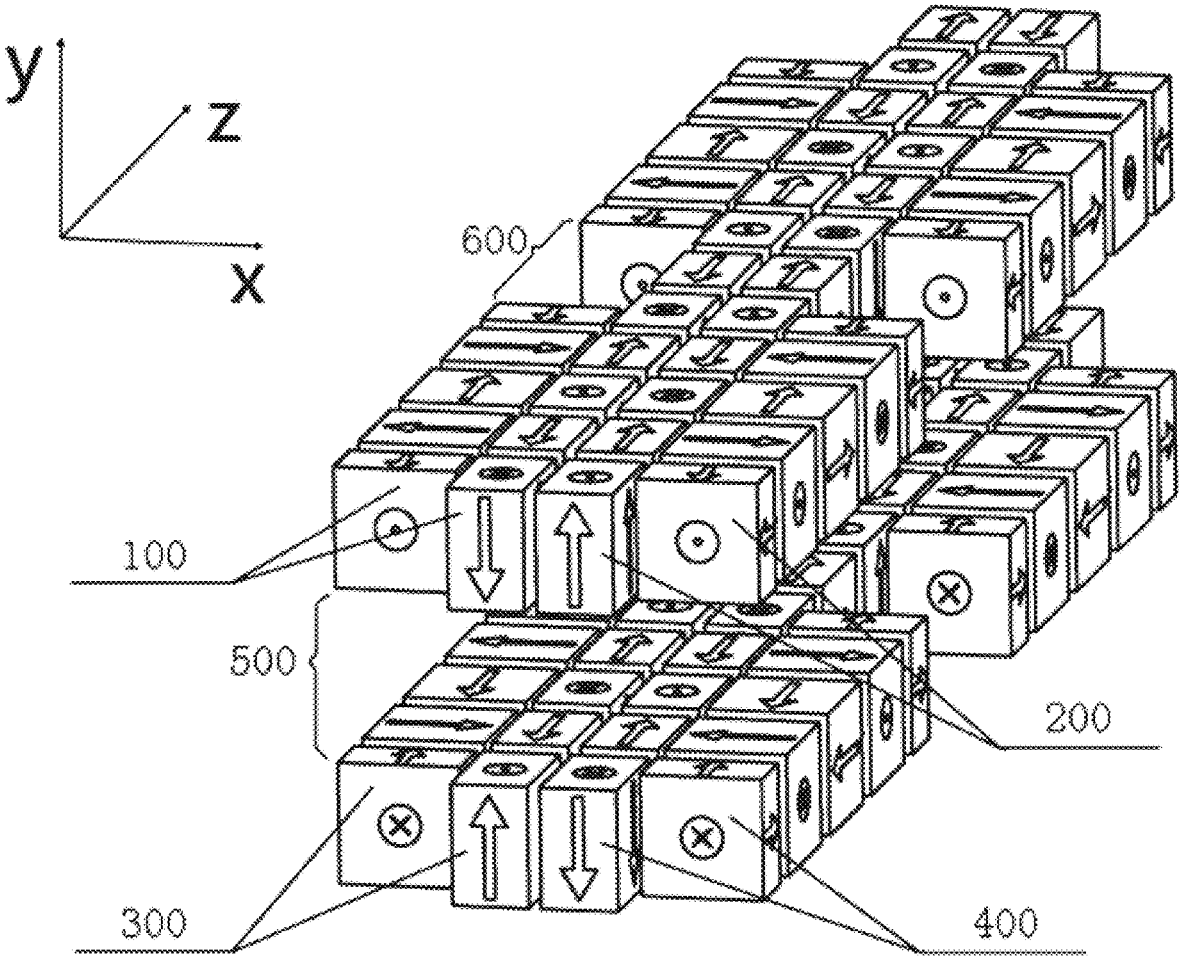
FIG. 6 shows a schematic diagram illustrating the arrangement of the APPLE-Knot magnet according to an embodiment of the present invention.
Figure 7:
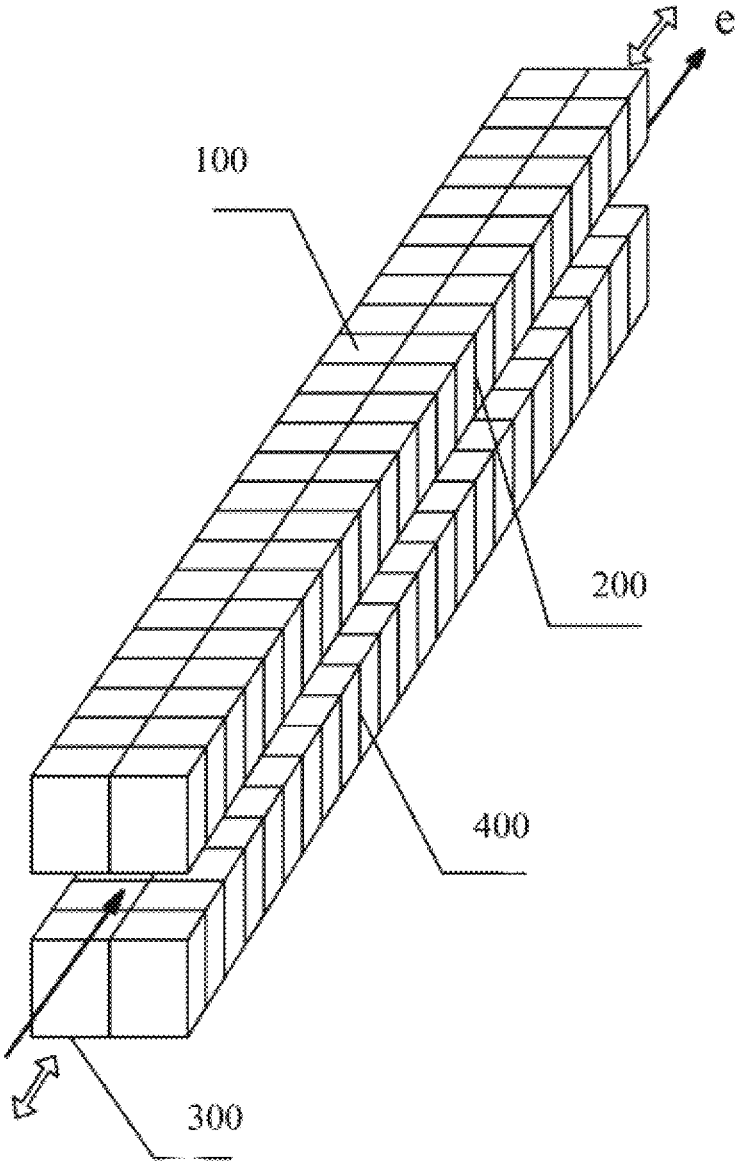
FIG. 7 shows a schematic diagram illustrating the arrangement of the magnets according to an embodiment of the present invention.

As shown in FIGS. 6 and 7, the undulator of the present invention comprises at least M permanent magnet periods arranged sequentially in a transmission direction of electron beams; each of the permanent magnet periods comprises four rows of permanent magnet structures, and each row of the permanent magnet structures comprises N rows of permanent magnet groups; each row of the permanent magnet groups comprises K permanent magnet units, wherein M, N and K are natural numbers greater than or equal to 1; the four rows of the permanent magnet structures are pairwise matched, then are relatively disposed on both sides of the transmission direction of electron beams. The four rows of permanent magnet structures are a first permanent magnet structure 100, a second permanent magnet structure 200, a third permanent magnet structure 300 and a fourth permanent magnet structure 400 respectively, and the arrangements thereof are shown in FIGS. 6 and 7. Wherein the first permanent magnet structure 100 and the second permanent magnet structure 200 are pairwise matched, and the third permanent magnet structure 300 and the fourth permanent magnet structure 400 are pairwise matched. The first permanent magnet structure 100 and the second permanent magnet structure 200 which are pairwise matched and the third permanent magnet structure 300 and the fourth permanent magnet structure 400 which are pairwise matched are relatively disposed on both sides of the transmission direction of electron beam e. The first permanent magnet structure 100 and the fourth permanent magnet structure 400 are disposed diagonally, and they are stationary. The second permanent magnet structure 200 and the third permanent magnet structure 300 are disposed diagonally, they are capable of moving along the transmission direction of electron beam e, and form displacement relative to the first permanent magnet structure 100 and the fourth permanent magnet structure 400. Different relative displacements can form many kinds of complex magnetic fields so as to generate elliptically polarized light, circularly polarized light or linearly polarized light with an arbitrary angle polarization direction of 0° to 360° when the electron beam passes through the composite magnetic fields, and such that the velocity directions of electrons deviate from an axis direction of the undulator, thereby the thermal loads deviate from the axis direction of the undulator.

Figure 4:
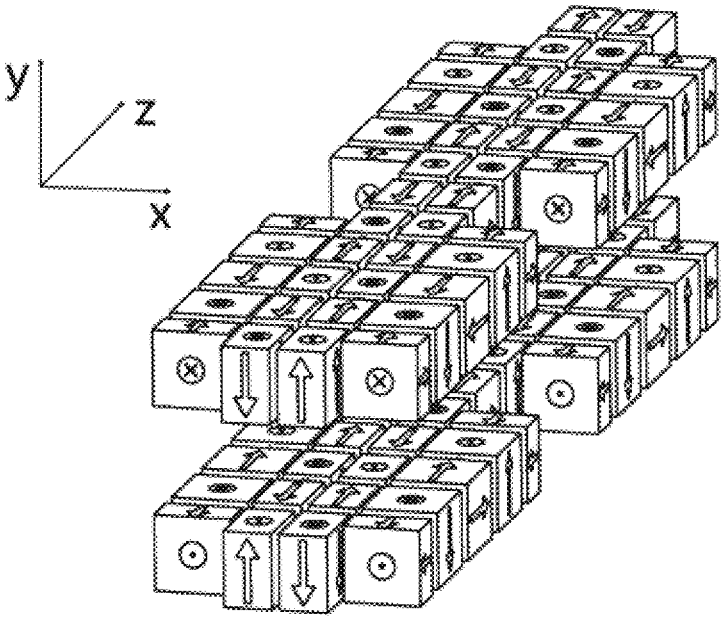
FIG. 4 (PRIOR ART)
FIG. 4 shows a schematic diagram illustrating the arrangement of magnets of the APPLE-Knot undulator according to the prior art indicated by the present invention.

As an embodiment of the present invention, the present invention proposes two types of undulator structures as shown in FIG. 6 and FIG. 7 to solve the problem that the auxiliary magnetic field is too weak. As shown in FIG. 6, each row of permanent magnet structures includes two rows of permanent magnet groups, wherein one row of the permanent magnet groups (the inner permanent magnet group) generates a main magnetic field, and the other row of permanent magnet groups (an outer permanent magnet group) generates an auxiliary magnetic field. Wherein the main magnetic field and the auxiliary magnetic field have different magnetic field periods, and the ratio of their magnetic field periods is 2:3. Wherein the permanent magnet units included in the permanent magnet groups corresponding to the auxiliary magnetic field has a magnetization direction perpendicular to the direction of a magnetic gap 500 of the undulator (i.e., y direction as shown in FIG. 6), and a magnetic field period of the auxiliary magnetic field is adapted to be adjusted by setting a vacant region 600 of the permanent magnet units contained in its corresponding permanent magnet groups. Compared the structures disclosed in FIG. 6 with that disclosed in FIG. 4, the magnetization direction of the magnet in the outer four rows of magnet groups in FIG. 4 is parallel to the direction of the magnetic gap. The magnetization directions of these magnets are rotated by 90 degrees to be perpendicular to the magnetic gap, and therefore a structure shown in FIG. 6 is formed. Thus, an auxiliary magnetic field with enough intensity is generated.

Figure 5:
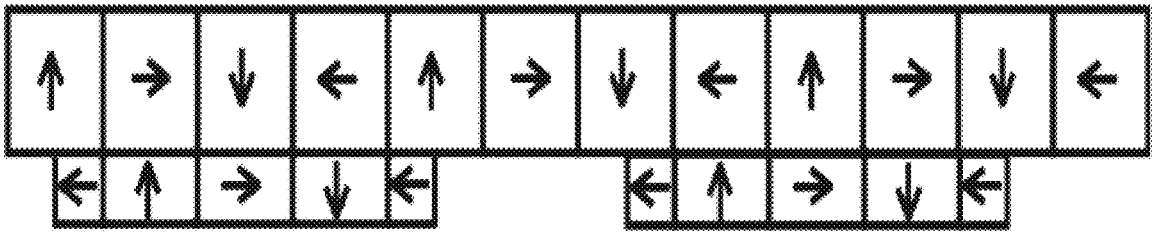
FIG. 5 (PRIOR ART)
FIG. 5 shows the magnetization directions of each permanent magnet units corresponding to the main magnetic field and the auxiliary magnetic field in each row of the permanent magnet structures in FIG. 4.

As shown in FIG. 7, each row of permanent magnet structures includes a row of permanent magnet groups, and the permanent magnet groups include K permanent magnet units with different magnetic deflection angles. Wherein the permanent magnet group is adapted to adjust the ratio of magnetic field intensity between the main magnetic field and the auxiliary magnetic field by decomposing its magnetic field into the main magnetic field and the auxiliary magnetic field having different magnetic field periods as shown in FIG. 5, and by adjusting the magnetic field deflection angle of each permanent magnet unit included in the permanent magnet groups.

It should be noted that the drawings illustrated in this embodiment merely illustrate a basic idea of the present invention in a schematic manner. Therefore, the drawings merely illustrate components related to the present invention, rather than the component number, shape and dimensional drawing according to the actual implementation. The component type, quantity and ratio can be randomly changed when it is actually implemented, and the component layout thereof may also be more complex.

Since each row of permanent magnet structures has a plurality of permanent magnet units having different magnetic field deflection angles, four rows of permanent magnet structures are generally suitable for vector-decomposing of the magnetic fields of all of the permanent magnets included therein to obtain two groups of magnetic field components, which are the main magnetic field (i.e., APPLE magnetic field) and the auxiliary magnetic field (i.e., Knot magnetic field), respectively. Wherein the main magnetic field and the auxiliary magnetic field have a period ratio of 2:3.

In this embodiment, the composite magnetic field is composed of the superposition of the main magnetic field and the auxiliary magnetic field. Many kinds of composite magnetic fields can be formed by relative displacement between the four rows of permanent magnet structures so as to generate elliptically polarized light, circularly polarized light or linearly polarized light with an arbitrary angle polarization direction of 0° to 360° when the electron beam passes through the composite magnetic fields, such that the velocity direction of electrons deviates from the axis direction of the undulator, thereby the thermal loads deviates from the axis direction of the undulator. The relative displacement between four rows of permanent magnet structures mainly includes two types. In a first type, by moving the second permanent magnet structure 200 and the third permanent magnet structure 300 in the same direction, the magnetic fields in the horizontal direction and the vertical direction of the main magnetic field and the auxiliary magnetic field will have a phase difference of 90°, such that circularly polarized synchrotron radiation can be generated.

In a second type, by displacing the second permanent magnet structure 200 and the third permanent magnet structure 300 in opposite directions, the magnetic fields in the horizontal direction and the vertical direction of the main magnetic field and the auxiliary magnetic field will have a phase difference of 0°, and the ratio of magnetic intensity in the horizontal direction to the vertical direction of the main magnetic field can be adjusted according to such displacement, thereby generating linearly polarized light having a certain angle.

When electrons conduct a cascaded left and right lateral movement or a pure left and right lateral movement in a composite magnetic field, a "knot" movement trajectory is formed. When electrons conduct a "knot" movement to generate elliptically polarized light, circularly polarized light, or linearly polarized light with an arbitrary polarization angle of 0° to 360°, the thermal loads will deviate from the axial direction of the undulator because the velocity direction of the electron deviates from the axial direction of the undulator. Diaphragms or apertures are provided in the axis direction of the undulator such that most of the thermal loads can be filtered out by diaphragms or apertures, which greatly reduces the thermal loads on the optical elements of the synchrotron radiation beamline.

In the present embodiment, there are seven permanent magnet periods arranged sequentially in a transmission direction of electron beams throughout the undulator. These seven permanent magnet periods ensure that the electron beams have a synchrotron radiation intensity higher than that of a single period when the electron beams move in the undulator periodically.

As another embodiment of the present invention, the present embodiment discloses a method of determining the magnetic deflection angle of a permanent magnet unit. The permanent magnet unit is adapted to adjust the ratio of the magnetic field intensity, i.e., the ratio of the magnetic field intensity of the main magnetic field to the auxiliary magnetic field, of the two magnetic field components in the x-axis and y-axis directions by orthogonally decomposing the magnetic field thereof into two magnetic field components in the x-axis and y-axis directions and by adjusting the magnetic deflection angle of the permanent magnet unit. Wherein the ratio of the magnetic field intensity of the main magnetic field to the auxiliary magnetic field is adapted to be adjusted according to the required energy of the fundamental wave photon, the energy of the electron beams and the length of the undulator such that an angle between the velocity direction of electrons and the axis direction of the undulator is greater than half of the acceptance angle of beamline, thereby obtaining a maximum light intensity under a condition of smaller thermal load.

Therefore, the magnetic field of a permanent magnet is a vector sum of two magnetic field components in the x-axis and y-axis directions, and the magnetic deflection angle is determined by the ratio of the magnetic field intensities of the magnetic field components in the two directions. The magnetic field directions of the two magnetic field components include a direction of the magnetic field in the plus or minus direction of the x-axis, and in the plus or minus direction of the y-axis.

Figure 8:
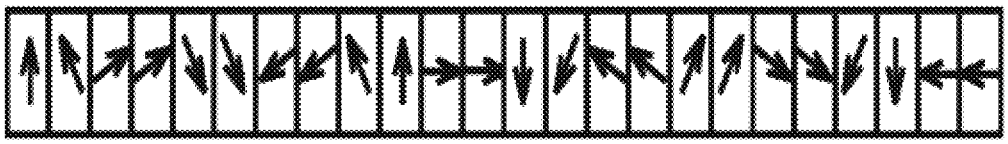
FIG. 8 shows a schematic diagram illustrating the magnetic deflection angles of the permanent magnet unit in each row of permanent magnet groups according to the embodiment of the present invention.

Please refer to FIG. 5, wherein the upper magnet group is a permanent magnet structure which needs to construct a main magnetic field, and the lower magnet group is a permanent magnet structure which needs to construct an auxiliary magnetic field. Each magnet block is divided into two pieces, the vectors of the main magnetic field and the auxiliary magnetic field are added together, and the total magnetic field intensity remains unchanged. Therefore, a permanent magnet unit having different magnetic deflection angles as shown in FIG. 8 is obtained. Magnetic deflection angle depends on the ratio of the vertically magnetic field intensity to the horizontally magnetic field intensity. As for this embodiment, the main magnetic field is used to generate synchrotron radiation, and the auxiliary magnetic field is used to deflect the electrons so as to induce a knot movement. The clockwise direction is regarded to be positive, and the upward vertical direction is regarded as a standard of zero degree angle. The larger the maximum deflection angle of the magnetic field of each permanent magnet is, the greater the magnetic field intensity of the auxiliary magnetic field is. Accordingly, the magnetic field intensity of the main magnetic field is smaller. Vice versa.

If the magnetic field intensity of the auxiliary magnetic field is too large, the angle of the maximum thermal loads direction deviating from the axis of undulator will be larger, the thermal loads on the optical elements of the beam line is lower. Correspondingly, due to the decrease of the main magnetic field intensity, the intensity of the synchrotron radiation light will be reduced, and higher synchrotron radiation intensity cannot be obtained. On the contrary, if the magnetic field intensity of the auxiliary magnetic field is too small, the deflection amplitude of the maximum thermal loads will be too small. The optical elements of the beamline will be subjected to a higher thermal load, which causes a larger thermal deformation. Therefore, the beamline performance cannot meet the requirement. Hence, it is necessary to adjust the magnetic deflection angle of each permanent magnet so as to adjust the magnetic field intensities of the main magnetic field and the auxiliary magnetic field, such that a maximum intensity of the synchrotron radiation light under a condition of a smaller thermal load can be obtained. A simple judgement rule is to make the minimum value of angle between the velocity direction of electrons and the axis of the undulator to be larger than half of the acceptance angle of the synchrotron radiation beamline.

Taking electron beams having energy of 3.5 GeV and an undulator having a length of 4.5 meters as an example, as for the required fundamental wave photon of 7 eV, the divergence angle, i.e., the acceptance angle of beamline, is 0.6 mrad. When each row of the permanent magnet structure includes a row of permanent magnet groups, and a ratio of the magnetic field intensity of the main magnetic field to the auxiliary magnetic field formed by the permanent magnet groups is 7:3, the minimum angle between the velocity direction of electrons and the axial direction of the undulator is greater than 0.3 mrad. At this time, the permanent magnet group includes 24 permanent magnet units. The clockwise direction is regarded to be positive, the upward vertical direction is regarded as a standard of zero degree angle, and the magnetic deflection angles of the 24 permanent magnet units are 0°, −23°, 67°, 67°, 157°, 157°, −113°, −113°, −23°, 0°, 90°, 90°, 180°, −157°, −67°, −67°, 23°, 23°, 113°, 113°, −157°, 180°, −90°, −90° respectively.

Of course, the energy coverage area of the fundamental wave photons as required may be various, and the ratio of the magnetic field intensity and the direction of the magnetic field of the two magnetic field components of each permanent magnet also include a plurality of types. Correspondingly, the magnetic deflection angle of each permanent magnet also has many kinds, which is not limited to the above-mentioned exemplary data.

In addition, compared with the permanent magnet in the prior art, the four rows of permanent magnet structures used in the embodiment of the present invention has a total number of rows of permanent magnets less than that of the prior art, which greatly reduces cost. Moreover, the installation of the four rows of permanent magnet structures is simpler than eight rows of permanent magnet structures.

Figure 9:
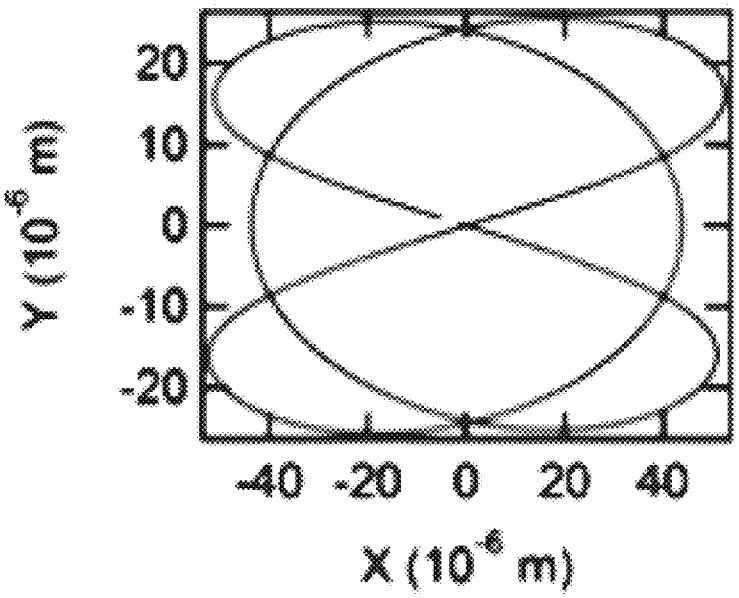
FIG. 9 shows a diagram illustrating the movement trajectory of the electrons in a first kind of composite magnetic field according to the embodiment of the present invention.
Figure 10:
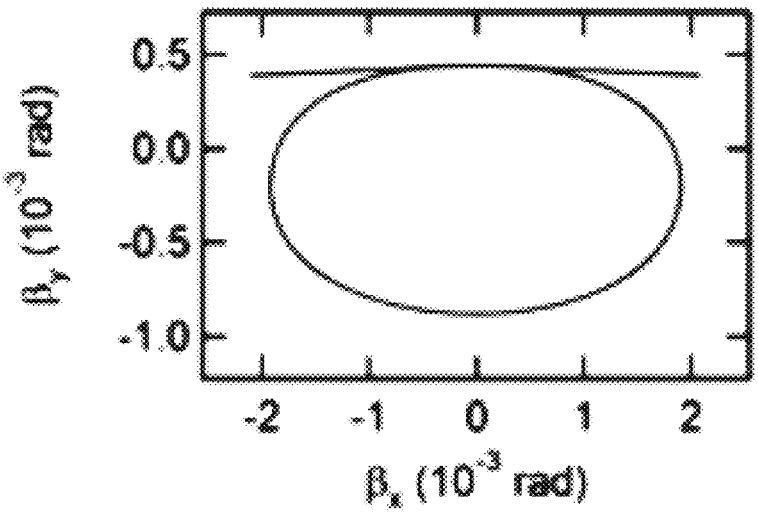
FIG. 10 shows a diagram illustrating the movement velocity of electrons in a first kind of composite magnetic field according to the embodiment of the present invention.
Figure 11:
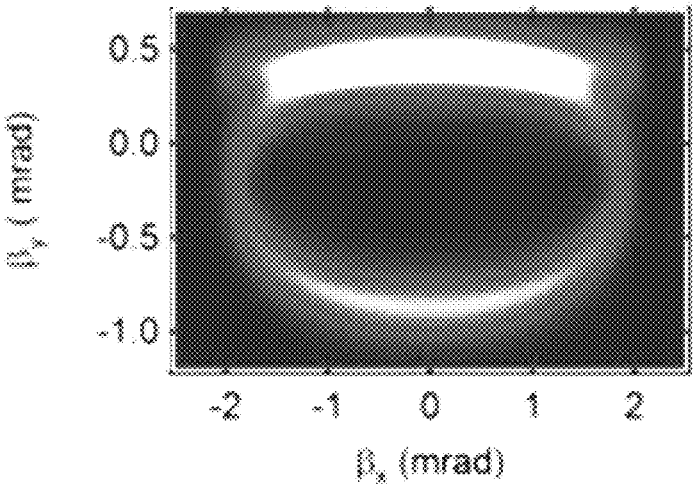
FIG. 11 shows a distribution diagram illustrating the thermal loads in a first kind of composite magnetic field according to the embodiment of the present invention.
Figure 12:
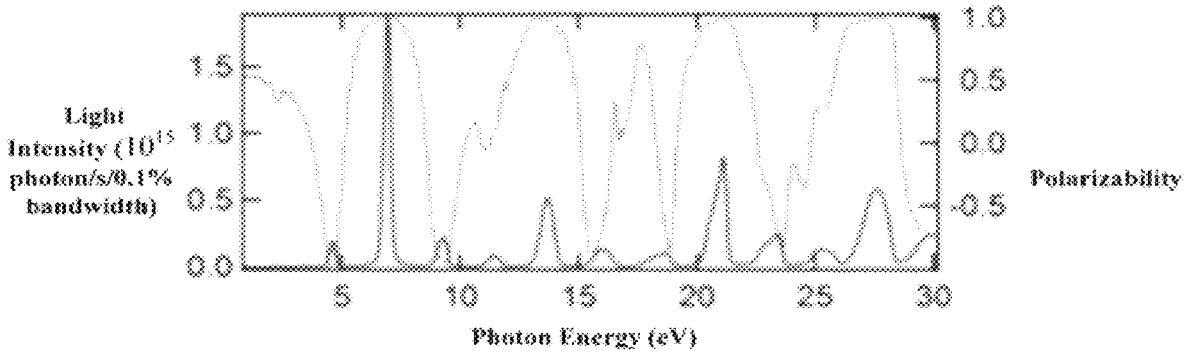
FIG. 12 shows a distribution diagram illustrating the photon energies generated in a first kind of composite magnetic field and the degree of linear polarization varied with the photon energies according to the embodiment of the present invention.

The principles of the undulator according to an embodiment of the present invention are as follows:

Taking $2\pi$ as a period, when the phase shift is 0, the second permanent magnet structure 200 and the third permanent magnet structure 300 do not move with respect to the first permanent magnet structure 100 and the fourth permanent magnet structure 400, and the magnetic gap between the first permanent magnet structure 100 and the second permanent magnet structure 200 located at one side of the transmission direction of electron beams e and the third permanent magnet structure 300 and the fourth permanent magnet structure 400 located at the other side of the transmission direction of electron beams e is 22 mm. Four rows of permanent magnet structures generate a first kind of composite magnetic field, and horizontally linearly polarized light will be generated at the fundamental wave energy when electron beams pass through the first composite magnetic field. When electrons conduct a cascaded left and right lateral movement in a composite magnetic field, the movement trajectory of the electrons are shown in FIG. 9 which presents a "knot" movement trajectory. The velocity curve of the electrons is shown in FIG. 10. A distribution diagram of its thermal loads is shown in FIG. 11. A distribution diagram illustrating the photon energies and the degree of linear polarization varied with the photon energies is shown in FIG. 12. A curve with a lighter color represents the linear polarization curve of the electrons according to the present embodiment. The horizontally linear polarization at a maximum light intensity of 7 eV is as high as 99.8%. According to the velocity curve shown in FIG. 10, the coordinate (0, 0) represents the axis direction of the undulator, and the velocity direction of electrons is never along the axis direction of the undulator. In this case, the maximum value of the thermal loads is shown in FIG. 11, which deviates from the axis direction of the undulator. Diaphragm is disposed at the optical axis of the beamline, the required fundamental wave photons pass through the diaphragm, and most of the thermal loads are filtered out by the diaphragm, which greatly reduces the thermal loads received by the optical elements.

Figure 13:
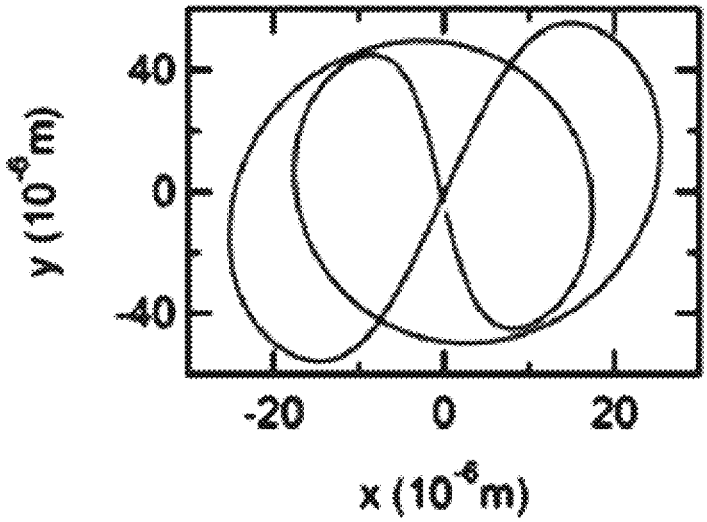
FIG. 13 shows a diagram illustrating the movement trajectory of the electrons in a second kind of composite magnetic field according to the embodiment of the present invention.
Figure 14:
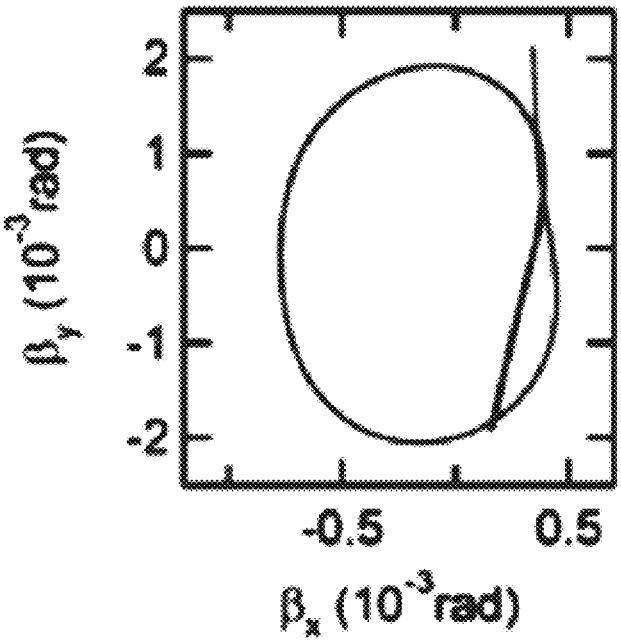
FIG. 14 shows a diagram illustrating the movement velocity of electrons in a second kind of composite magnetic field according to the embodiment of the present invention.
Figure 15:
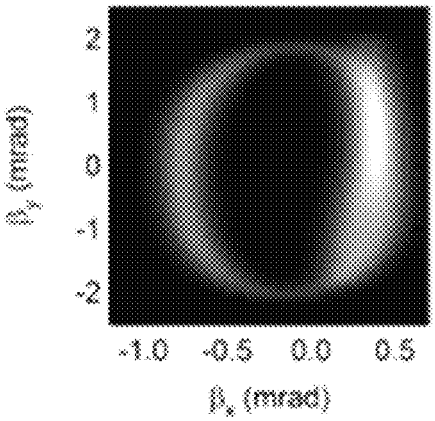
FIG. 15 shows a distribution diagram illustrating the thermal loads in a second kind of composite magnetic field according to the embodiment of the present invention.
Figure 16:
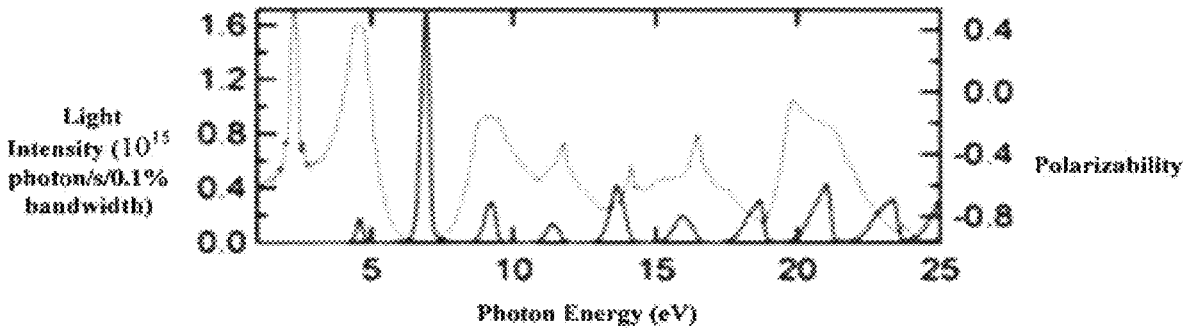
FIG. 16 shows a distribution diagram illustrating the photon energies generated in a second kind of composite magnetic field and the degree of linear polarization varied with the photon energies according to the embodiment of the present invention.

The second permanent magnet structure 200 and the third permanent magnet structure 300 are respectively moved by phase positions of $+\pi$ and $-\pi$ with respect to the first permanent magnet structure 100 and the fourth permanent magnet structure 400, the magnetic gap is adjusted to be 18 mm, and the four rows of magnet structures generate a second kind of composite magnetic field. When the electron beam passes through the second composite magnetic field, it generates vertically linearly polarized light at the fundamental wave energy. Electrons conduct a cascaded left and right lateral movement in the composite magnetic field, and the movement trajectory of the electrons are shown in FIG. 13 which presents a slight "knot" movement trajectory. The movement velocity of the electrons is shown in FIG. 14. A distribution diagram of its thermal loads is shown in FIG. 15. A distribution diagram illustrating the photon energies and the degree of linear polarization varied with the photon energy is shown in FIG. 16. A curve with a lighter color represents the linear polarization curve of the electrons according to the present embodiment. The vertically linear polarization at a maximum light intensity of 7 eV is as high as 96.7%. The negative polarization in the figure represents the vertical polarization.

Figure 17:
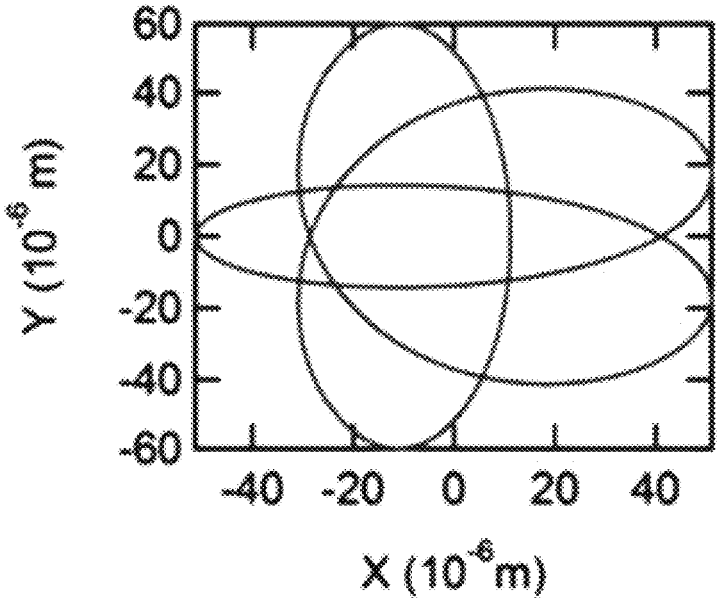
FIG. 17 shows a diagram illustrating the movement trajectory of the electrons in a third kind of composite magnetic field according to the embodiment of the present invention.
Figure 18:
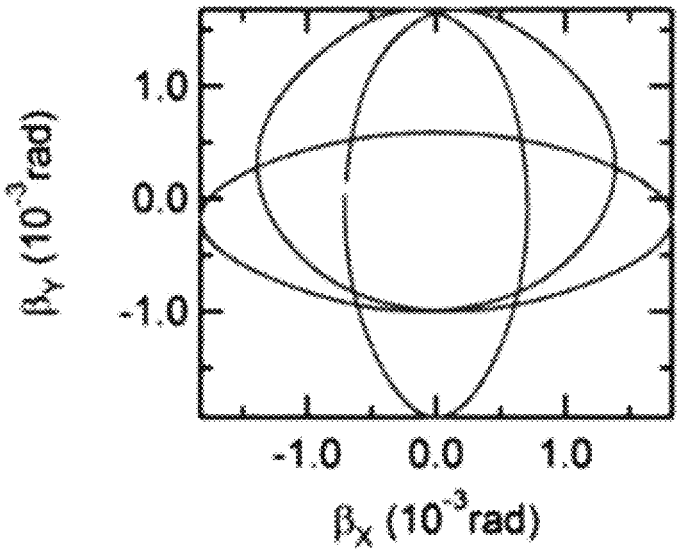
FIG. 18 shows a diagram illustrating the movement velocity of electrons in a third kind of composite magnetic field according to the embodiment of the present invention.
Figure 19:
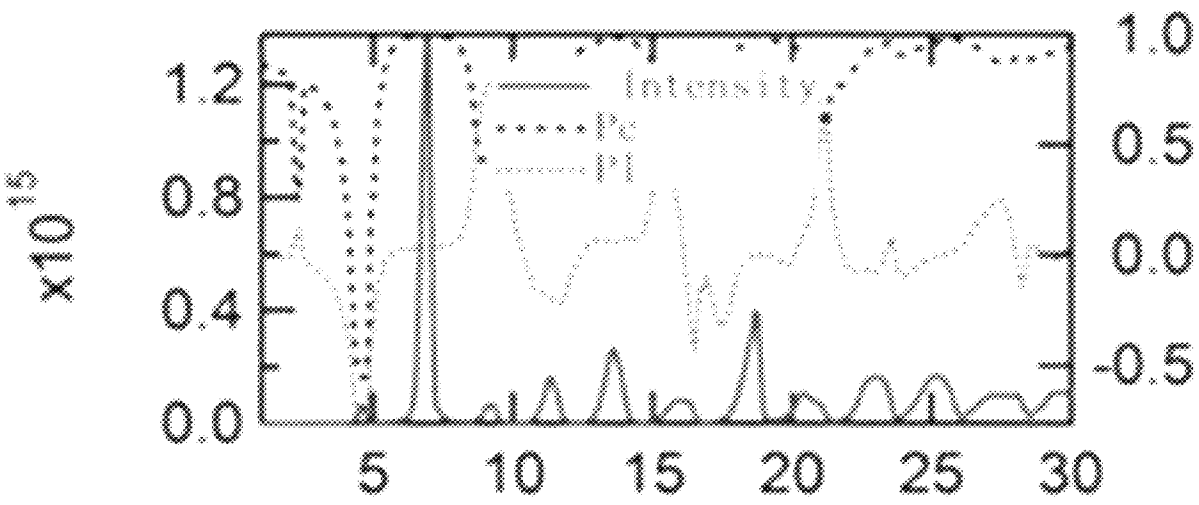
FIG. 19 shows a distribution diagram illustrating the photon energies generated in a third kind of composite magnetic field and the degree of circular polarization varied with the photon energies according to the embodiment of the present invention.
Figure 20:
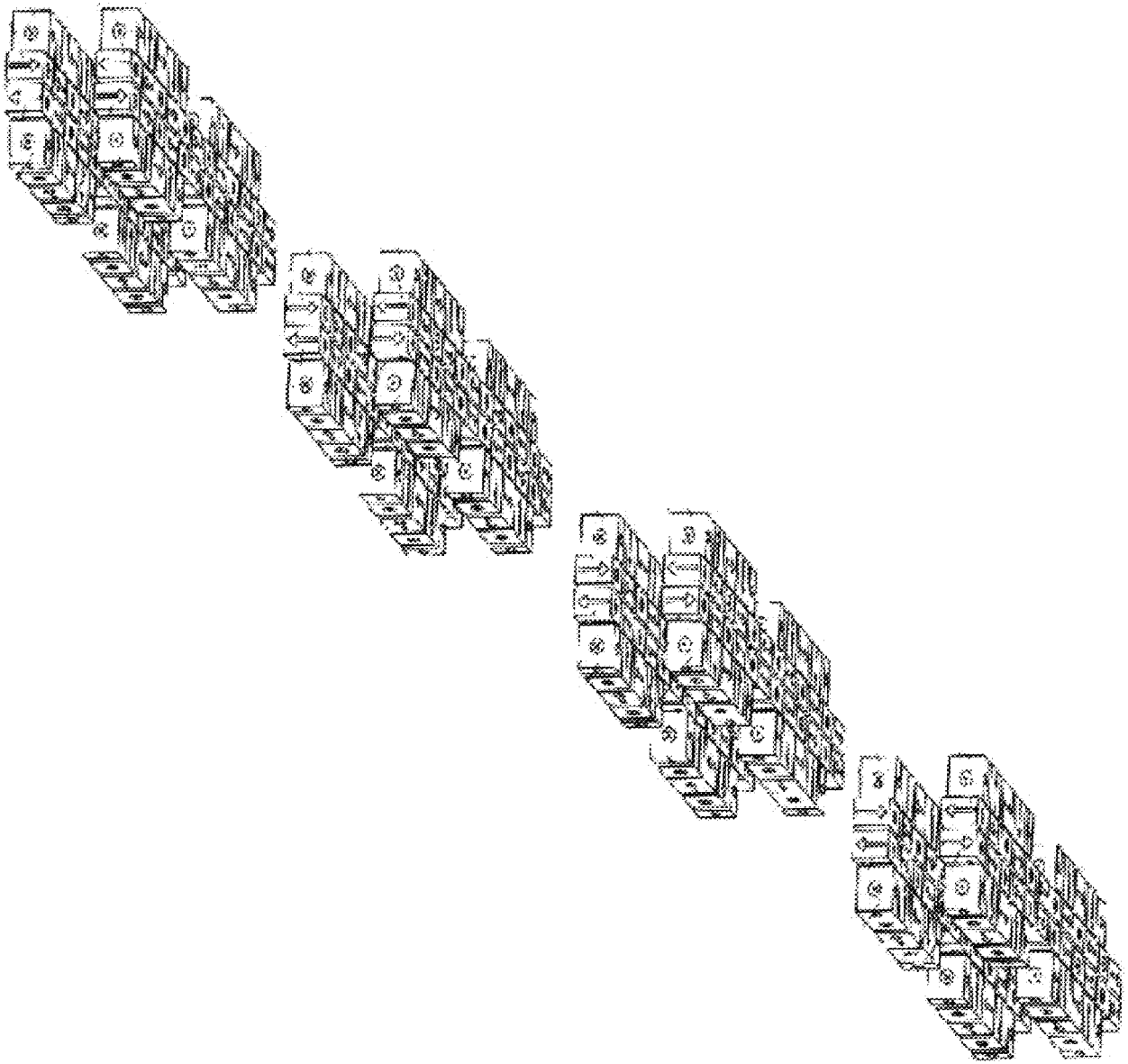
FIG. 20 shows 4 permanent magnet periods arranged sequentially in a transmission direction of electron beams.

The second permanent magnet structure 200 and the third permanent magnet structure 300 are moved by phase positions of $0.505\pi$ with respect to the first permanent magnet structure 100 and the fourth permanent magnet structure 400, the magnetic gap is adjusted to be 18.5 mm, and the four rows of permanent magnet structures generate a third kind of composite magnetic field. When the electron beam passes through the third composite magnetic field, it generates circularly polarized light at the fundamental energy. Electrons conduct a cascaded right lateral movement in the composite magnetic field, and the movement trajectory of the electrons are shown in FIG. 17 which presents a more complicated "knot" movement trajectory. The movement velocity curve of the electrons is shown in FIG. 18. A distribution diagram illustrating its photon energy, linear polarization and circular polarization is shown in FIG. 19. A dotted line with a dark color represents the circular polarization curve varied with the electron energies. The circular polarization at a maximum light intensity of 7 eV is as high as 99.8%.

Given the above, the undulator of the present invention can not only generate horizontally polarized light and vertically polarized light, but also generate circularly polarized light, which can meet the needs of various synchrotron radiations. Under the function of different magnetic fields formed by relative displacements of the four rows of permanent magnet structures, no matter the horizontally linearly polarized light, the vertically linearly polarized light, or the circularly polarized light is generated, an angle between the velocity direction of electrons and the axis direction of the undulator is greater than half (i.e., 0.017°) of the divergence angle of its fundamental wave photons having a light intensity of 7 eV. The velocity direction of electrons is never along the axis direction of the undulator, and the maximum value of the thermal load deviates from the axis of the undulator, which greatly reduces the thermal loads on the synchrotron beamline.

In addition, it should be noted that each of the permanent magnet units is made of neodymium iron boron material, and saturation magnetic field intensity thereof is larger than or equal to 1.25 T. The undulator further comprises: a stationary magnet bracket and a moving magnet bracket, and a stationary magnet group and a moving magnet group are respectively fixed on the stationary magnet bracket and the moving magnet bracket. Driven by the moving magnet bracket, a moving permanent magnet structure is adapted to move different displacements relative to the fixed permanent magnet structure to generate different composite magnetic fields, thereby generating polarized light having different polarizations. Taking FIGS. 6 and 7 as an example, the second permanent magnet structure 200 and the third permanent magnet structure 300 are moving permanent magnet structures, and the first permanent magnet structure 100 and the fourth permanent magnet structure 400 are fixed magnet structures.

To sum up, the undulator of the present invention has the following beneficial effects:

First, many kinds of complex magnetic fields can be formed in the undulator of the present invention. Under the function of the composite magnetic fields, linearly polarized synchrotron radiation or circularly polarized synchrotron radiation can be generated by alternately left and right lateral movements of electrons. The velocity direction of electrons will never be along the axis direction of the undulator, and an angle between the velocity direction of electrons and the axis direction of the undulator is greater than half of an divergence angle of the fundamental wave photons as needed, such that the thermal loads deviate from the axis direction of the undulator, the thermal loads along the axis direction of the undulator are greatly reduced, and most of the thermal loads can be filtered out via the diaphragm on the optical axis. Therefore, the heat loads on optical elements of the beamlines which receive synchrotron radiation can be greatly reduced.

Secondly, the present invention can use four rows of permanent magnet groups. Compared with the APPLE-8 and APPLE-Knot undulator structures in the prior art, the number of rows of permanent magnets is reduced by half, which greatly saves the cost. In addition, the problem of difficult installation of eight rows of permanent magnet groups is overcome.

Thirdly, the undulator of the present invention can generate horizontally linearly polarized light and vertically linearly polarized light, as well as elliptically polarized light, circularly polarized light and linearly polarized light with an arbitrary polarization angle of 0°~360°, which can satisfy the requirement of many kind of synchrotron radiation applications. Therefore, the present invention effectively overcomes various disadvantages in the prior art, and has a high value in industry.

The above-mentioned embodiments are just used for exemplarily describing the principle and the effect of the present invention instead of limiting the present invention. One skilled in the art may make modifications or variations to the above-mentioned embodiments without departing from the spirit and scope of the present invention. Therefore, all equivalent modifications or variations made by one skilled in the art without departing from the spirit and technical concept disclosed by the present invention shall be also covered by the claims of the present invention.

What is claimed is:

1. An undulator at least comprising: M permanent magnet periods arranged sequentially in a transmission direction of electron beams, each of the permanent magnet period(s) comprises four permanent magnet structures, each permanent magnet structures comprises two permanent magnet groups, and each permanent magnet groups comprises a row of K permanent magnet(s), wherein M and K are natural numbers greater than or equal to 1;

the four permanent magnet structures are pairwise matched, and are relatively disposed on both sides of the transmission direction of electron beams, and are capable of forming at least one kind of composite magnetic fields by relative displacement, such that elliptically polarized light, circularly polarized light, or linearly polarized light with an arbitrary polarization angle is generated when the electron beams pass through the composite magnetic fields, and velocity directions of electrons are deviated from an axis direction of the undulator;

the groups in inner side of the permanent magnet structures constitute a first assembly, and the groups in the outer side of the permanent magnet structures constitute a second assembly;

wherein the first assembly generates a main magnetic field, the second assembly generates an auxiliary magnetic field;

the permanent magnets included in the permanent magnet groups corresponding to the auxiliary magnetic field have a magnetization direction perpendicular to a gap direction of the undulator, and a magnetic field period of the auxiliary magnetic field is adapted to be adjusted by setting a vacant region in its corresponding permanent magnet groups.

2. The undulator according to claim 1, wherein the main magnetic field and the auxiliary magnetic field have different magnetic field periods.

3. The undulator according to claim 2, wherein the main magnetic field and the auxiliary magnetic field are adapted to be adjusted according to an energy of fundamental photon, an energy of electron beam and a length of the undulator as needed, such that an angle between a velocity direction of electrons and an axis direction of the undulator is greater than half of an acceptance angle of the fundamental wave photon as needed, thereby obtaining a maximum light intensity under a condition of a smaller thermal load.

4. The undulator according to claim 3, wherein the energy of the electron beam is 3.5 GeV, the length of the undulator is 4.5 m, the energy of the fundamental photon as needed is 7 eV, the acceptance angle of fundamental photons is 0.6 mrad, wherein a ratio of the magnetic field intensity between the main magnetic field and the auxiliary magnetic field formed by the permanent magnet groups is 7:3.

5. The undulator according to claim 1, wherein a ratio of the magnetic field periods of the main magnetic field to and the auxiliary magnetic field is 2:3.

6. The undulator according to claim 1, wherein the permanent magnet are made of neodymium iron boron material, and saturation magnetic field intensity of the permanent magnet units are larger than or equal to 1.25 T.

7. The undulator according to claim 1, wherein the undulator further comprises: two stationary magnet brackets and two moving magnet brackets, the two permanent magnet structures are fixed on the stationary magnet brackets respectively to form two fixed permanent magnet structures, the other two permanent magnet structures are fixed on the moving magnet brackets respectively to form two moving permanent magnet structures; driven by the moving magnet brackets, the moving permanent magnet structures are adapted to move different displacements relative to the fixed permanent magnet structures to generate different composite magnetic fields, thereby generating polarized light having different polarizations.

8. An undulator, at least comprising: M permanent magnet period(s) arranged sequentially in a transmission direction of electron beams, each of the permanent magnet periods comprises four permanent magnet structures, and each permanent magnet structure comprises K permanent magnet(s), wherein M and K are natural numbers greater than or equal to 1;

the magnetic directions of K permanent magnets have different angles relative to the upward direction;

the four permanent magnet structures are pairwise matched, and are relatively disposed on both sides of the transmission direction of electron beams, and are capable of forming at least one kind of composite magnetic fields by relative displacement, such that elliptically polarized light, circularly polarized light, or linearly polarized light with an arbitrary polarization angle is generated when the electron beams pass through the composite magnetic fields, and velocity directions of electrons are deviated from an axis direction of the undulator.

9. The undulator according to claim 8, wherein the magnetic field generated by four magnetic structures is decomposed into the main magnetic field and the auxiliary magnetic field according to different magnetic directions, the intensity ratio of main and auxiliary magnetic field is adjusted by changing magnetic direction of the permanent magnets.

10. The undulator according to claim 8, wherein the energy of the electron beam is 3.5 GeV, the length of the undulator is 4.5 m, the energy of the fundamental photon as needed is 7 eV, the acceptance angle of fundamental photons is 0.6 mrad, wherein a ratio of the magnetic field intensity between the main magnetic field and the auxiliary magnetic field formed by the permanent magnet structures is 7:3; wherein the permanent magnet structures comprise 24 permanent magnets; a clockwise direction is regarded to be positive, a upward direction is regarded as a zero degree angle, and the angles of magnetic direction of the 24 permanent magnets are 0°, −23°, 67°, 67°, 157°, 157°, −113°, −113°, −23°, 0°, 90°, 90°, 180°, −157°, −67°, −67°, 23°, 23°, 113°, 113°, −157°, 180°, −90°, −90°.

* * * * *